United States Patent [19]

Shotwell

[11] 4,383,496

[45] May 17, 1983

[54] IMPROVED PAINT GUIDE

[76] Inventor: Allen M. Shotwell, 207 Simpson Howell Rd., Elizabeth, Allegheny County, Pa. 15037

[21] Appl. No.: 360,469

[22] Filed: Mar. 22, 1982

[51] Int. Cl.[3] ..... B05C 11/00

[52] U.S. Cl. ..... 118/504; 118/505

[58] Field of Search ..... 51/262 R, 262.1, 274, 51/310; 118/504, 505; 427/272, 282, 286

[56] References Cited

U.S. PATENT DOCUMENTS

| | | | |
|---|---|---|---|
| 804,569 | 11/1905 | Watson . | |
| 1,386,706 | 8/1921 | Hall . | |
| 1,411,462 | 4/1922 | Wendt . | |
| 1,697,200 | 1/1929 | Morgana et al. . | |
| 2,098,005 | 11/1937 | Holt | 91/65 |
| 2,484,607 | 10/1949 | Cherem | 91/65 |
| 2,517,220 | 8/1950 | Lister | 91/65 |
| 2,538,743 | 1/1951 | Alston | 91/65 |
| 2,893,042 | 7/1959 | Paskaly | 15/257 |
| 3,335,703 | 8/1967 | Buehler | 118/504 |
| 3,942,472 | 3/1976 | McAlister | 118/504 |
| 4,241,693 | 12/1980 | Shotwell | 118/504 |

FOREIGN PATENT DOCUMENTS

| | | |
|---|---|---|
| 5156 | of 1910 | United Kingdom . |
| 683776 | 12/1952 | United Kingdom . |
| 911553 | 11/1962 | United Kingdom . |

*Primary Examiner*—Michael R. Lusignan
*Attorney, Agent, or Firm*—Frease & Bishop

[57] ABSTRACT

A paint guide includes a frame having a shield which terminates in a straight paint sealing edge that is spaced a predetermined distance from a window frame to provide a strip of weatherproofing paint on the window glass adjacent the frame when painting the frame. The shield is movably mounted by a pair of L-shaped brackets on a pair of supporting arms by cams. The cams are slidably mounted within slots formed in the arms to control the movement of the sealing edge. A compression coil spring extends between each of the brackets and associated arm and biases the bracket and shield upwardly from the window glass to move the sealing edge out of engagement with the glass. When downward pressure is applied to the frame, the paint sealing edge is moved vertically into engagement with the glass at a predetermined spaced distance outwardly from the window frame due to the sliding action of the cams within the arm slots. Continued pressure on the shield seals the paint edge tightly against the glass. After completion of the paint application along the straight edge between the supporting arms, the pressure on the frame is released, whereupon the springs raise the paint sealing edge vertically from the glass to prevent smearing of the fresh paint, after which the paint guide can be slid on the glass to an adjacent unpainted area.

13 Claims, 7 Drawing Figures

IMPROVED PAINT GUIDE

BACKGROUND OF THE INVENTION

1. Field of the Invention

The invention relates to devices for use primarily in the painting of window frames and particularly to a paint shield and guide which prevents paint from contacting and smearing unwanted portions of a surface, such as the window glass immediately adjacent the frame or other area being painted. More particularly, the invention relates to a paint guide which enables a predetermined strip of paint to remain on the window glass adjacent the frame to form a weather seal therebetween during painting of the window frame.

2. Description of the Prior Art

It is desirable in painting the wooden frames of windows and doors to extend the paint outwardly a slight distance from the frame onto the adjacent portion of the glass to form a weather seal between the glass and frame, or between the glass and putty or sealing compound to prevent moisture which accumulates on the glass from seeping into the joint between the frame and glass, resulting in deterioration of the wood frame or sealing compound. Also, when painting other frame structures which may be made of metal or synthetic materials, such as plastic, vinyl or the like, it is desirable to provide a guide or shield to prevent the paint which is being applied to the frame from contacting and being smeared on the adjacent glass. A paint guide will facilitate the painting of a window frame by eliminating the tedious application of the paint to prevent smearing paint on the glass, as heretofore required, and by eliminating the use of outlining the glass with masking tape or other similar procedure to provide for a smooth strip of weatherproofing paint on the glass adjacent the frame.

Various paint guides or masking devices have been constructed to facilitate the painting of window or door frames, such as shown in U.S. Pat. Nos. 804,569, 1,386,706, 1,411,462, 2,098,005, 2,484,607, 2,517,220, 2,538,743, and 3,335,703, and in British Pat. Nos. 5,156, 683,776 and 911,553. Most of these devices require that the edge of the guide device be wiped after each application of paint to a particular frame section adjacent the paint guide, increasing considerably the difficulty and time required for each painting job. Many of these prior devices do not enable a weatherproofing strip of paint to be applied evenly and neatly on the window glass since the guide edge is abutted directly against the adjacent frame. Also, these devices may still smear the glass with paint if they are not removed properly after the painting operation has been completed.

U.S. Pat. No. 3,335,703 discloses a device which is believed to be the closest device known to my paint guide construction. It shows a device which can be positioned a predetermined distance from a window frame to provide for a weatherproofing strip of paint and uses a movable paint guide edge. However, if this device is used for this purpose, it would be extremely difficult to properly position the paint guide edge at the same predetermined distance from the frame for each application to provide for a straight, uniform thickness strip of paint on the window, since there is no positive positioning means provided on this device. Also, rotational movement of the paint guide edge could contact the window frame, smearing the freshly applied paint.

Many of these problems have been eliminated by the paint guide shown in my earlier U.S. Pat. No. 4,241,693. Although the paint guide shown in this patent has proven successful, my further improved paint guide disclosed below provides a simpler, less expensive, more easily manufactured, and more easily operated guide by replacing the U-shaped arms and operating link mechanism of my earlier guide with a simpler and more efficient cam and slot arrangement.

SUMMARY OF THE INVENTION

Objectives of the invention include providing a paint guide construction which is intended primarily for use in painting window frames more quickly and conveniently than known devices, and which provides for a strip of weatherproofing paint to be applied to the window glass adjacent the frame junction during the painting of the frame, and in which the width of this paint strip is adjustable; providing such a device in which the paint sealing edge of the paint shield is moved vertically toward and away from the glass by an improved cam and slot mounting arrangement to eliminate smearing of the weatherproof paint strip, freshly painted frame and adjacent unpainted window surface; providing such a device which can be slid along the window frame when moving from a painted area to the adjacent unpainted area, since the supporting surfaces of the paint guide are all spaced away from the window frame and weatherproofing strip with the only contact with the frame being the front projections of the spaced guide supporting arms; providing such a device in which the vertical movement of the paint sealing edge away from the glass and applied paint strip initially is achieved by the biasing force of a pair of compression coil springs, thereby reducing further the possibility of smearing the freshly painted surface and adjacent unpainted glass areas; providing such a device in which no wiping of the paint shield and paint sealing edge is required after each painting operation due to the vertical movement of the paint sealing edge with respect to the glass surface, and in which positive locating means are provided for accurately positioning the paint sealing edge at the predetermined distance away from the frame for each paint application to form a neat, continuous, straight edge on the weatherproofing paint strip; and providing such a paint guide construction which is of a relatively inexpensive and rugged construction, which eliminates difficulties heretofore encountered, achieves the stated objectives simply and effectively, and solves problems and satisfies needs existing in the art.

These objectives and advantages are obtained by the improved paint guide construction, the general nature of which may be stated as including a frame having a paint shield terminating in a straight edge; a pair of spaced arm means movably mounting the frame therebetween for movement of the straight edge between raised and lowered positions, said arm means extending generally transverse with respect to the paint shield edge and terminating in front locating ends; spring means operatively engageable with the frame and arm means for biasing the paint shield edge toward the raised position wherein the edge is disengaged from a surface to be painted; and cam means operatively engageable with and extending between the frame and arm means to impart generally straight line movement to the paint shield edge when said edge moves toward and away from a surface being painted when moving between lowered and raised positions, respectively.

BRIEF DESCRIPTION OF THE DRAWINGS

A preferred embodiment of the invention, illustrative of the best mode in which applicant has contemplated applying the principles, is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 1:
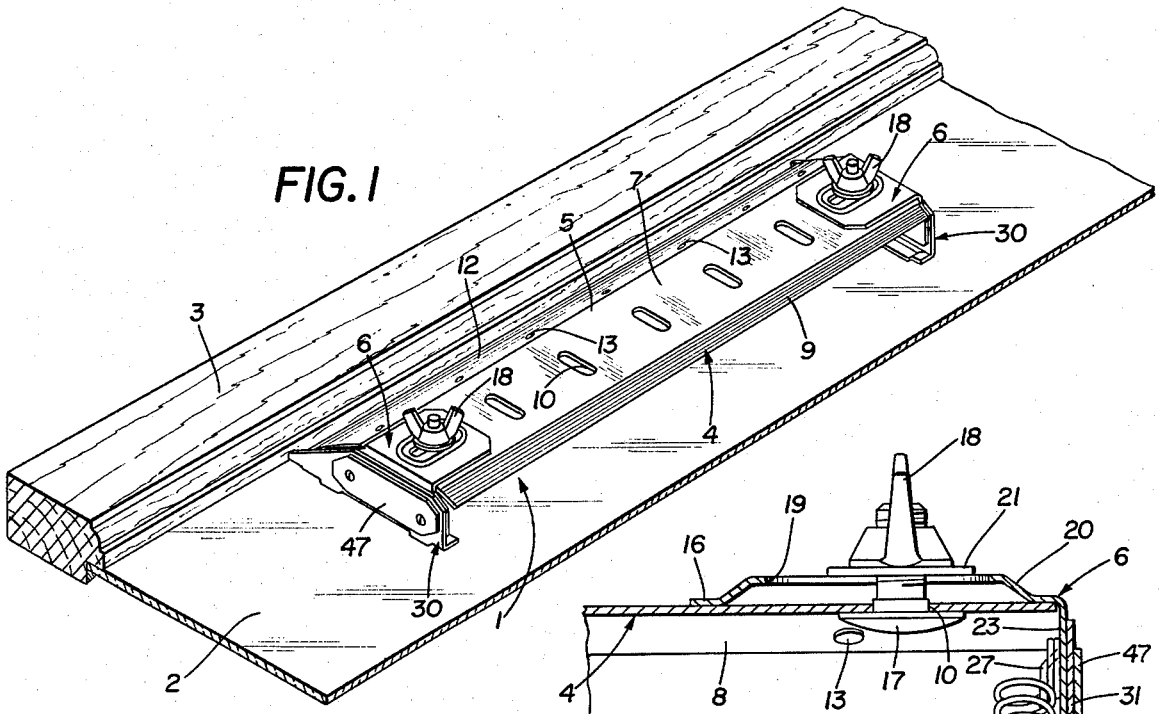
FIG. 1 is a perspective view of the improved paint guide construction shown in operating position on a portion of a window.

The improved paint guide construction is indicated generally at 1, and is shown in FIG. 1 in a usual mode of operation in which it is placed against a pane of window glass 2 and abuttingly engages a window frame 3 for painting the same. Paint guide 1 includes a frame, indicated generally at 4, which preferably is formed by a piece of sheet metal having a central body portion 5 and a pair of spaced L-shaped end brackets 6. Central portion 5 has a flat top wall 7 and downwardly, outwardly extending front and rear flanges 8 and 9 formed integrally with top wall 7 and extending throughout the length of top wall 7. A plurality of transversely extending slots 10 are formed in top wall 7 of frame 4 to provide an adjustment feature for device 1, as described in greater detail below.

A paint shield 12, formed of flexible metal or plastic material, is attached to front flange 8 of top wall 7 by a plurality of rivets 13. Paint shield 12 has a somewhat outwardly bowed configuration, shown particularly in FIGS. 5 and 6, and terminates in a straight paint sealing edge 14, which extends longitudinally throughout the length of shield 12.

Figure 4:
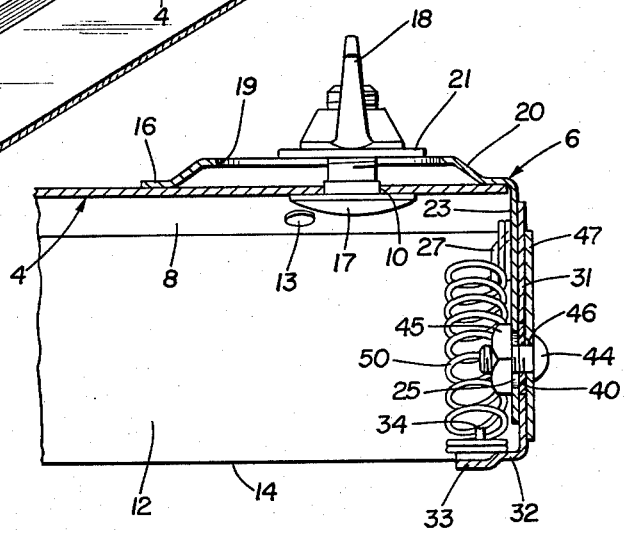
FIG. 4 is an enlarged fragmentary sectional view taken on line 4—4, FIG. 2.
Figure 3:
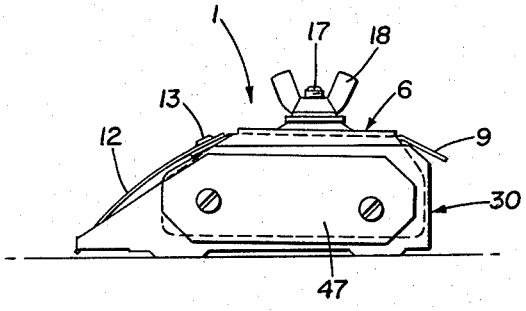
FIG. 3 is a left-hand end elevational view of the improved paint guide shown in FIG. 2.
Figure 2:
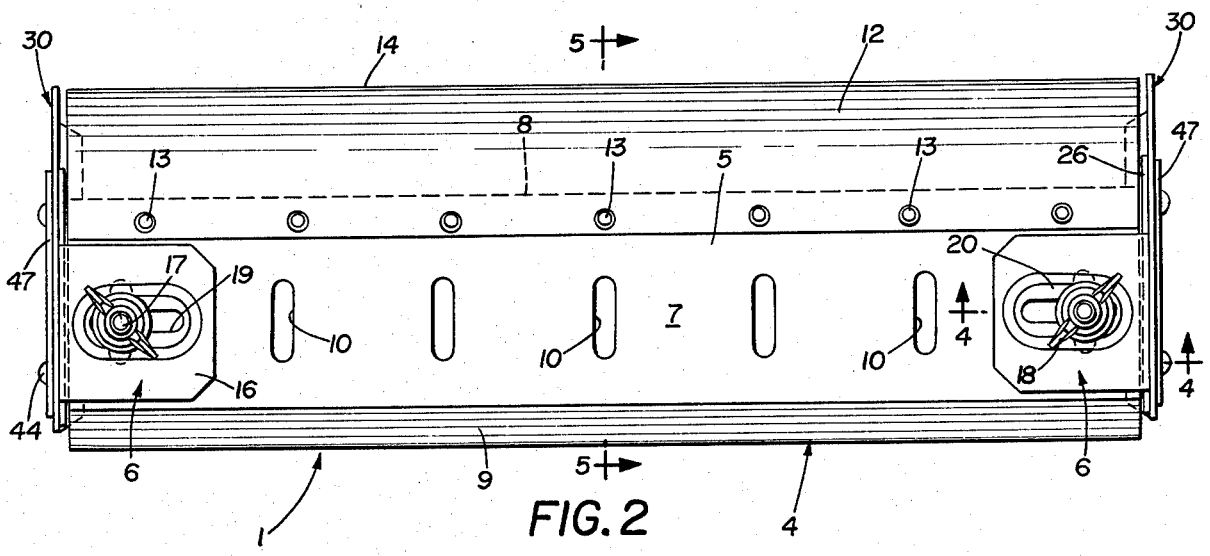
FIG. 2 is an enlarged top plan view of the improved paint guide construction shown in FIG. 1 removed from the window.

Each end bracket 6 (FIG. 7) has a first or horizontal leg 16 which is attached to top wall 7 by a carriage bolt 17 and wing nut 18 (FIG. 4). Each bolt 17 extends through the endmost slot 10 of wall 7 and through an elongated hole 19 formed in horizontal leg 16 which is surrounded by a raised boss 20. A washer 21 is mounted on bolt 17 and is clamped against boss 20 of bracket leg 16 by wing nut 18. Bracket 6 also includes a second or vertically downwardly extending leg 23 which is formed with a pair of spaced vertically extending holes 24 and 25 and an outwardly extending tab 27. Vertical leg 23 has a frontwardly extending end portion 26 which extends beyond horizontal leg 16.

Figure 5:
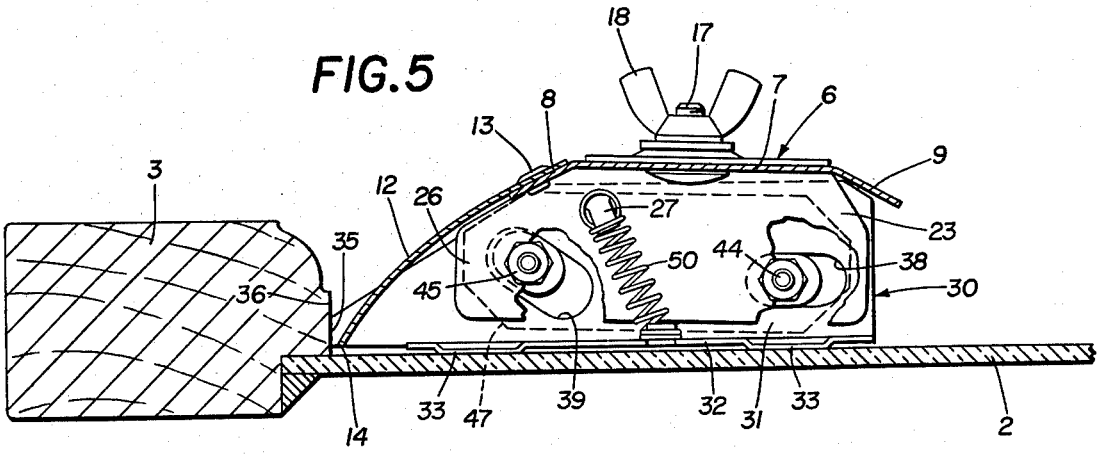
FIG. 5 is an enlarged sectional view with portions broken away taken on line 5—5, FIG. 2, showing the improved paint guide in operating position on a window, with the paint guide edge shown in a raised position.
Figure 6:
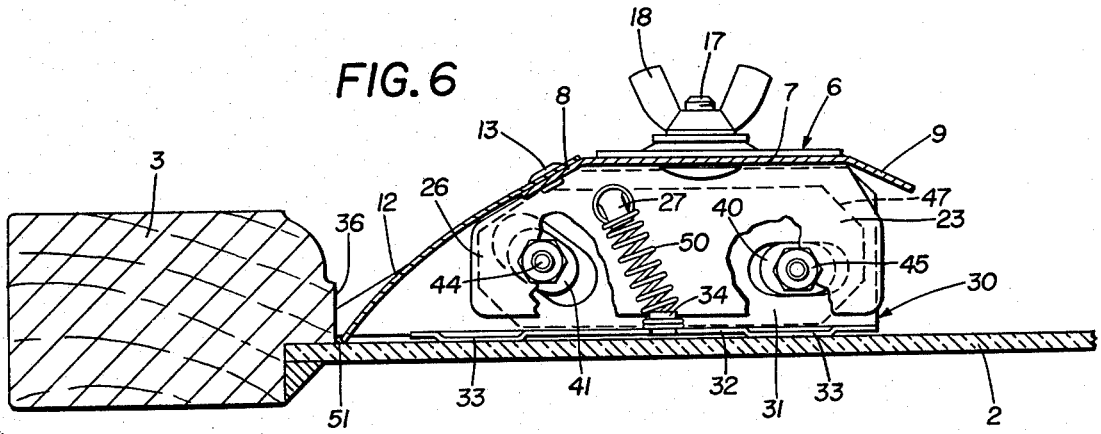
FIG. 6 is a view similar to FIG. 5 with the paint guide edge shown in its lowered sealed position against the window glass.

In accordance with one of the main features of the invention, guide frame 4 is movably mounted between a pair of frame-supporting arms, each of which is indicated generally at 30, for imparting generally straight line movement to paint shield edge 14 when moving between a lowered, paint sealing position, as shown in FIG. 6, and a raised position, as shown in FIG. 5.

Figure 7:
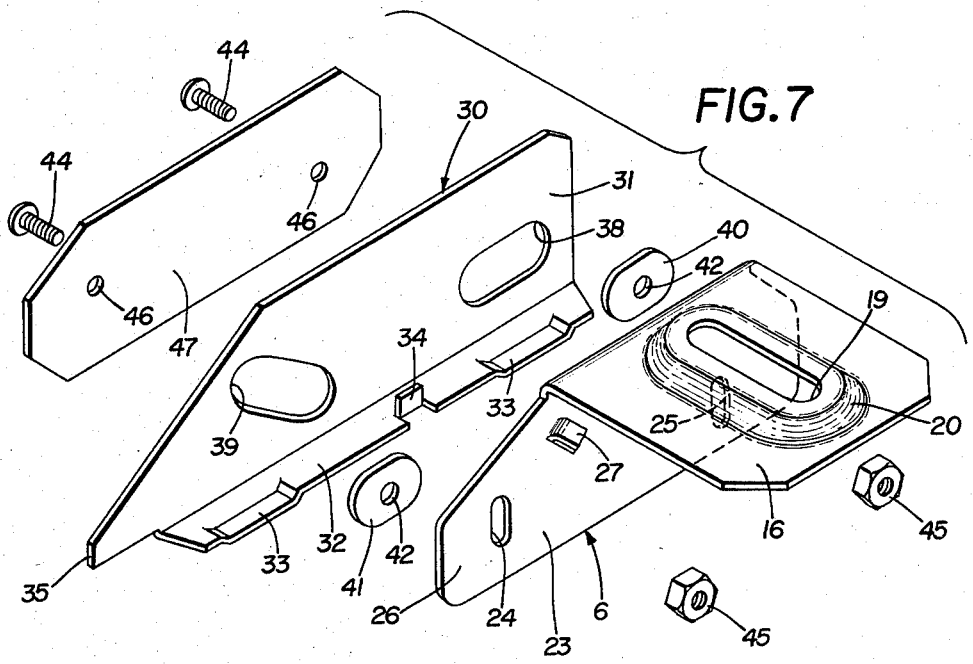
FIG. 7 is an exploded perspective view of one of the frame mounting arm assemblies of the improved paint guide showing the cam and slot mounting arrangement.

Support arms 30 are identical to each other; therefore, only one arm is shown in detail in FIG. 7. Arm 30 preferably is stamped from a piece of sheet metal and includes a main vertical upstanding wall 31 and an inwardly extending bottom flange or edge 32. A pair of spaced depressions 33 are stamped in bottom edge 32 which function as the points of support or feet for paint guide 1 when in operating position as shown in FIGS. 5 and 6. An upwardly extending tab 34 also is formed in edge 32 between depression 33. Each arm 30 terminates in a forward end 35 which is adapted to be placed in abutting engagement with surface 36 of window frame 3 when using paint guide 1 to provide positive locating means for guide 1. Ends 35 extend forwardly beyond bottom edges 32 and feet 33.

A pair of elongated generally oval-shaped cam slots 38 and 39 are formed in vertical wall 31 of each supporting arm 30 for slidably receiving therein cam washers 40 and 41, respectively. Cams 40 and 41 preferably are similar in shape and size to each other and have a generally oval-shaped configuration with a central hole 42. The cams may be formed of a hard rubber or similar material. Cam slot 38 has its longitudinal or major axis extending generally parallel to bottom edge 32 and transverse to sealing edge 14, with the longitudinal or major axis of cam slot 39 extending in an upward-forward direction with respect to bottom edge 32.

Guide frame 4 is movably mounted on frame-supporting arms 30 by a pair of bolts 44 and corresponding nuts 45 (FIG. 7) which extend through holes 46 formed in a clamping plate 47 and through holes 42 of cams 40 and 41 and through vertical holes 24 and 25 of L-shaped bracket leg 23. When in assembled position, cams 40 and 41 are movably mounted within their respective slots 38 and 39, and arms 30 are movably clamped between clamping plate 47 and vertical leg 23 of frame brackets 6. The width or minor axis of oval-shaped slot 38 is generally equal to the minor axis of cam 40, with the longitudinal axis of slot 38 being greater than that of cam 40 to permit only horizontal sliding movement of cam 40 within slot 38. The minor axis of cam slot 39 is formed slightly larger than the minor axis of cam 41 as well as the longitudinal or major axis of slot 39 being greater than the corresponding major axis of cam 41 to provide some "play" of cam 41 within slot 39.

A pair of compression coil springs 50 is connected to tabs 34 of supporting arms 30 and to tabs 27 of bracket leg 23 at the ends of frame 4 biasing frame 4 and paint sealing edge 14 to the raised position of FIG. 5.

The operation of the improved paint guide construction is shown particularly in FIGS. 1, 5 and 6, and is described below. Frame 4 is adjusted with respect to frame-supporting arms 30 by loosening wing nuts 18 and moving central body portion 5 of frame 4 transversely with respect to arms 30 along slots 10. Adjustment also can be made by positioning bolts 44 along vertical slots 24 and 25 of L-shaped bracket leg 23. This adjustment provides the desired width of a weatherproofing paint strip 51 which will extend outwardly on glass 2 from frame 3, which is the distance between frame edge 36 of frame 3 and paint shield edge 14 when in its sealed position against glass 2.

Device 1 is placed on glass 2 and forward ends 35 of supporting arms 30 are abutted against frame edge 36, as shown in FIG. 5. In this position, device 1 is engaged with glass 2 only by bottom edge feet 33 of arms 30. These points of contact are the only parts of guide 1 which will contact glass 2, except for paint shield edge 14. Springs 50 bias paint shield 12 away from glass 2 so that paint shield edge 14 initially is spaced from glass 2 when guide 1 is placed thereon. A very slight downward pressure on top wall 7 of frame portion 5, preferably by the user's thumb, overcomes the biasing force of springs 50, bringing paint edge 14 into contact with glass 2 (FIG. 6). During this initial downward movement, cams 40 and 41 move from their forward position in cam slots 38 and 39 to a more rearward position, as shown in FIG. 6. Cam 41, in addition to sliding rearwardly in slot 39, will also move slightly downwardly therein during the downward movement of paint shield 12 and edge 14 when overcoming the biasing of springs 50.

The particular angular relationship of cam slots 38 and 39 controls the movement of shield 12, enabling paint shield edge 14 to move nearly vertically in a straight line fashion into engagement with glass 2 instead of traveling in an arcuate path, as would occur if frame 4 or shield 12 were only pivotally mounted on arms 30. This initial movement of shield 12 and edge 14 is limited to the "play" provided by the cam-slot arrangement and provides the initial contact of paint shield edge 14 with the glass at the predetermined distance, indicated by space 51, from frame edge 36.

Continued pressure on top wall 7 of frame 4 will force paint shield edge 14 tightly against glass 2 to form an effective paint seal therewith. While pressure is maintained on top wall 7, paint is applied to frame 3 and adjacent strip of glass throughout the area between frame-supporting arms 30 along shield 12, with the predetermined weatherproofing paint strip being applied on glass 2 throughout space 51. Paint is prevented from contacting the remaining portion of the glass due to the effective seal of paint shield edge 14 with glass 2.

Immediately after paint is applied to frame 3 and to the glass in space 51, pressure is released from frame top wall 7, whereupon paint sealing edge 14 will move generally vertically upwardly away from the glass, as shown in FIGS. 5 and 6, due to the biasing force of springs 50. The action provided by the movement of cams 40 and 41 in slots 38 and 39 lift paint shield edge 14 from the glass without any sliding movement of the paint sealing edge along the glass, which occurs in many prior devices. This vertical lifting motion prevents smearing of the paint strip in space 51 and smearing of paint onto the remaining unpainted glass surface.

Guide 1 then can be slid easily along the frame to the adjacent unpainted area without even lifting the guide from the glass since bottom edge feet 33 which support guide 1 are completely rearward of the painted area 51 and out of contact with any freshly painted area. As soon as guide 1 is moved to the adjacent unpainted area, frame 4 is depressed again, which actuates the sequence of actions described above to effectively seal edge 14 against glass 2 for the next painting operation.

One of the main advantages of paint guide 1 is that sealing edge 14 does not have to be wiped of paint which collects thereon after each paint application, since the vertical movement of edge 14 toward and away from glass 2 eliminates any possibility of this paint contacting that portion of the glass surface which is to remain unpainted.

Should no strip of weatherproofing paint be desired on glass 2, paint shield 12 is adjusted by the movement of bolts 17 along slots 10 of frame wall 7 so that paint shield edge 14 is located in alignment with the forward locating ends 35 of supporting arms 30 when in depressed position. Even in this position, no paint smearing will occur since the action achieved by the sliding movement of cams 40 and 41 in slots 38 and 39 moves paint shield edge 14 in a generally straight vertical manner with respect to glass 2, eliminating contact with frame edge 35 and with unpainted areas of glass 2. Also, if a shorter longitudinal length paint guide is desired, frame 4 can be cut to the desired length after removal of one end support bracket 6, which then is reattached to the endmost slot 10.

The improved paint guide 1 provides a device which is formed relatively inexpensively, preferably of stamped sheet metal components which are assembled with relative ease; it enables a weatherproof strip of paint of a variable width to be applied to the glass at the frame junction; it eliminates wiping of the paint shield and sealing edge after each painting application; it enables the shield to be slid rearwardly or laterally along the window frame without smearing the previously applied paint since the supporting feet of the paint shield are all rearward of the applied paint strip and frame; and it provides a unique spring-biased cam-control mechanism whereby the paint sealing edge is moved into and out of engagement with the glass in a generally straight line direction, which eliminates smearing and scuffing at the paint line to provide a neat and straight paint sealing line.

Accordingly, the improved paint guide construction is simplified, provides an effective, safe, inexpensive and efficient device which achieves all the enumerated objectives, provides for eliminating difficulties encountered with prior paint guides and shields, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved paint guide construction is constructed, assembled and operated, the characteristics of the new construction, and the advantageous, new and useful results obtained; the new and useful structures, devices, elements, arrangements, parts and combinations are set forth in the appended claims.

I claim:

1. A paint guide construction including:

(a) a frame having a paint shield terminating in a straight edge;

(b) a pair of spaced arm means movably mounting the frame therebetween for movement of the straight edge between raised and lowered positions, said arm means extending generally transverse with respect to the paint shield edge and terminating in front locating ends;

(c) spring means operatively engageable with the frame and arm means for biasing the paint shield edge toward the raised position wherein the edge is disengaged from a surface to be painted; and (d) cam means operatively engageable with and extending between the frame and arm means to impart generally straight line movement to the paint shield edge when said edge moves toward and away from a surface being painted when moving between lowered and raised positions, respectively.

2. The construction defined in claim 1 in which the frame includes a central body portion and a pair of brackets mounted in a spaced relationship on the central body portion; in which the paint shield is connected to the central body portion and extends outwardly downwardly therefrom; and in which each of the brackets is operatively connected to a respective arm means by the spring means and cam means.

3. The construction defined in claim 2 in which a slot is formed in the main body of the frame adjacent each end thereof; and in which fastening means extends through each of said frame slots and is engaged with a respective bracket to adjustably mount the main body portion of the frame on the brackets to adjust the paint shield edge with respect to the front ends of the arm means.

4. The construction defined in claim 2 in which each of the brackets is L-shaped having first and second legs; in which the first leg is attached to the central body portion of the frame; in which each of the arm means is attached to a respective one of the second legs.

5. The construction defined in claim 1 in which the paint shield straight edge is located rearwardly of the front locating ends of the arm means to provide a space between said edge and a structure being painted when the paint shield is placed on a surface adjacent said structure and the front ends of the arms are abutted against said structure for forming a weatherproofing painted strip in said space on the adjacent surface.

6. The construction defined in claim 2 in which the cam means includes a pair of elongated slots formed in a spaced relationship in each of the spaced arm means; in which a cam is slidably mounted in each of the slots; and in which each of the arms means is movably mounted on a respective frame bracket by fasteners which fixedly mount the cams with respect to the brackets while locating said cams in their respective slots.

7. The construction defined in claim 6 in which a clamping end plate is mounted on each of the frame brackets by the cam fasteners; and in which each of the arm means is movably mounted on the cams between a respective clamping end plate and frame bracket.

8. The construction defined in claim 6 in which each of the arm means has a bottom edge which supports the paint guide on a surface being painted; in which one of the cam slots extends in a transverse direction with respect to the frame straight edge generally parallel to the bottom edge of the arm means; and in which the other of said cam slots extends in an upward forward direction with respect to said bottom edge.

9. The construction defined in claim 8 in which a pair of spaced feet is formed on each of the bottom edges of the arm means for supporting the paint guide on a surface being painted.

10. The construction defined in claim 7 in which each of the cams is an elongated generally flat oval-shaped washer; and in which the fasteners are bolts which extend through holes formed in the cam washers.

11. The construction defined in claim 10 in which the fastener bolts extend through vertical slots formed in the frame brackets to adjustably mount the paint shield edge with respect to the front locating ends of the arm means.

12. A paint guide construction of the type adapted to be placed on a glass window pane when painting the window frame, said construction including:

(a) a frame member having a paint shield terminating in a straight paint sealing edge;

(b) a pair of spaced arms movably supporting the paint shield therebetween, said arms each terminating in a front end which projects outwardly beyond the paint sealing edge, said front ends being adapted to abuttingly engage the window frame to space said paint sealing edge a predetermined distance from the window frame to provide an exposed strip of glass at the junction with the window frame for receiving a weatherproofing strip of paint thereon during painting of the frame;

(c) spring means operatively engageable with the frame member and arms for biasing the paint shield straight edge toward a raised position whereby said paint sealing edge is disengaged from the window pane until a manual pressure is applied to the frame member; and (d) cam means operatively engageable with and extending between the frame member and arms to impart generally straight line movement to the sealing edge when said edge moves between engaged and disengaged positions against the window pane.

13. The construction defined in claim 12 in which the spring means is a pair of compression coil springs.

* * * * *